US011010987B2

(12) United States Patent
Bucci

(10) Patent No.: US 11,010,987 B2
(45) Date of Patent: May 18, 2021

(54) TICKET BURSTER

(71) Applicant: IGT GLOBAL SOLUTIONS CORPORATION, Providence, RI (US)

(72) Inventor: Paul A. Bucci, Glocester, RI (US)

(73) Assignee: IGT Global Solutions Corporation, Providence, RI (US)

( * ) Notice: Subject to any disclaimer, the term of this patent is extended or adjusted under 35 U.S.C. 154(b) by 0 days.

(21) Appl. No.: 16/129,250

(22) Filed: Sep. 12, 2018

(65) Prior Publication Data

US 2020/0082642 A1 Mar. 12, 2020

(51) Int. Cl.

| | |
|---|---|
| ***G07B 5/02*** | (2006.01) |
| ***G07B 3/02*** | (2006.01) |
| ***G07C 15/00*** | (2006.01) |
| ***G07F 17/32*** | (2006.01) |
| *B26F 3/00* | (2006.01) |
| *B65H 35/10* | (2006.01) |
| *B65H 79/00* | (2006.01) |

(52) U.S. Cl.

CPC ..... *G07B 5/02* (2013.01); *G07B 3/02* (2013.01); *G07C 15/005* (2013.01); *G07F 17/329* (2013.01); *B26F 3/002* (2013.01); *B65H 35/10* (2013.01); *B65H 79/00* (2013.01); *B65H 2701/1936* (2013.01)

(58) Field of Classification Search

CPC ..... G07B 5/02; G07B 3/02; G07F 17/329; G07C 15/005; B26F 3/002; B65H 79/00; B65H 2701/1936; B65H 35/10

See application file for complete search history.

(56) References Cited

U.S. PATENT DOCUMENTS

| | | | | |
|---|---|---|---|---|
| 8,127,973 | B2 * | 3/2012 | Mirkovic | G07B 3/02 225/100 |
| 9,613,337 | B1 | 4/2017 | Garrison | |
| 9,685,026 | B1 | 6/2017 | Garrison | |
| 2004/0000572 | A1 * | 1/2004 | Engelhardt, Jr. | B26D 5/32 225/1 |
| 2005/0178810 | A1 | 8/2005 | Woods et al. | |
| 2007/0017978 | A1 | 1/2007 | Ho | |

* cited by examiner

*Primary Examiner* — Stephen Choi

(74) *Attorney, Agent, or Firm* — Neal, Gerber & Eisenberg LLP

(57) ABSTRACT

Embodiments of a ticket burster employ a dividing wall that is movable between different positions to facilitate dispensing tickets of different sizes, and a sensor that detects and communicates the position of the dividing wall to a controller. The controller communicates with feed motors to selectively operate feed drive rollers independently or in unison depending upon the detected position of the dividing wall.

7 Claims, 11 Drawing Sheets

TICKET BURSTER

BACKGROUND

The present disclosure relates generally to ticket vending, and more particularly to lottery ticket bursting devices and methods.

Lottery tickets are offered in different sizes and may be purchased in different ways. For example, instant win lottery tickets of different sizes can be purchased in a traditional retail environment, where players enter a retail establishment that sells the lottery tickets and purchase the ticket(s) from a retail clerk. Regardless of ticket size, the clerk may tear the purchased ticket(s) from a roll of tickets that are joined by perforation, for example.

Self-service terminals, such as lottery ticket vending devices, permit players to purchase lottery tickets without interacting with a retail clerk. Self-service terminals can provide a menu of ticket options for a player, receive a form of payment and a selection from the player, and issue the selected ticket to the player from an exit area of the terminal. Typically, the menu of ticket options corresponds to different game tickets previously stored in ticket packs in the self-service terminal. Typically, the tickets in the ticket pack are connected in sequence by perforation. As a ticket in a given pack is purchased, the self-service terminal can employ a ticket burster to move the ticket toward the exit area of the terminal and burst the perforation, thereby separating the selected ticket from the pack for the player.

BRIEF SUMMARY

The present disclosure relates generally to a ticket burster device and method for bursting tickets of different sizes. Embodiments can employ a housing, a controller and a cutter blade, wherein the controller communicates with a group of feed motors to selectively operate feed drive rollers independently or in unison depending upon the desired operation as determined by the size(s) of the tickets to be burst. In various embodiments, a dividing wall secured to the housing is movable between different positions to facilitate dispensing tickets of different sizes. Further, in various embodiments, a sensor secured to the housing detects whether the dividing wall is in an extended or retracted position and communicates the detected position to the controller, whereby the controller can then automatically direct the feed motors to operate the feed drive rollers in unison or independently based on the communicated position. Embodiments of the cutting blade extend a length suitable for bursting tickets of different sizes regardless of the position of the dividing wall.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Example embodiments such as disclosed herein can incorporate a controller having a processor and an associated memory storing instructions that, when executed by the processor, cause the processor to perform operations as described herein. It will be appreciated that reference to "a", "an" or other indefinite article in the present disclosure encompasses one or more than one of the described element. Thus, for example, reference to a processor encompasses one or more processors, reference to a memory encompasses one or more memories, reference to a motor encompasses one or more motors and so forth.

Figure 1:
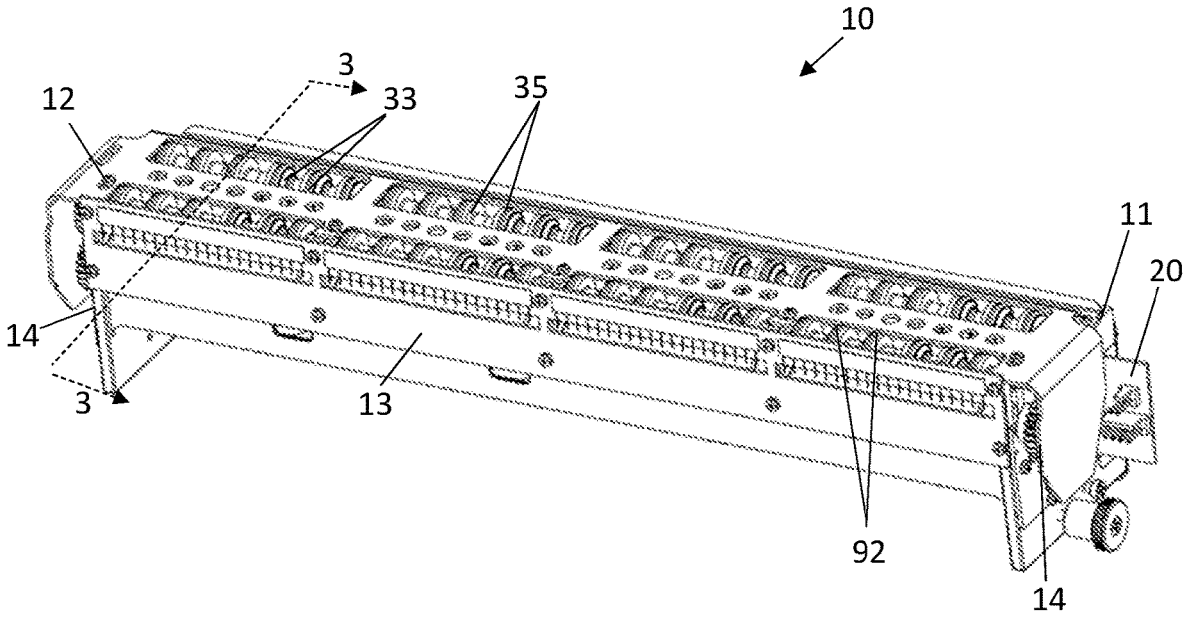
FIG. 1 is a front perspective view of a ticket burster device in accordance with embodiments of the present disclosure.
Figure 2:
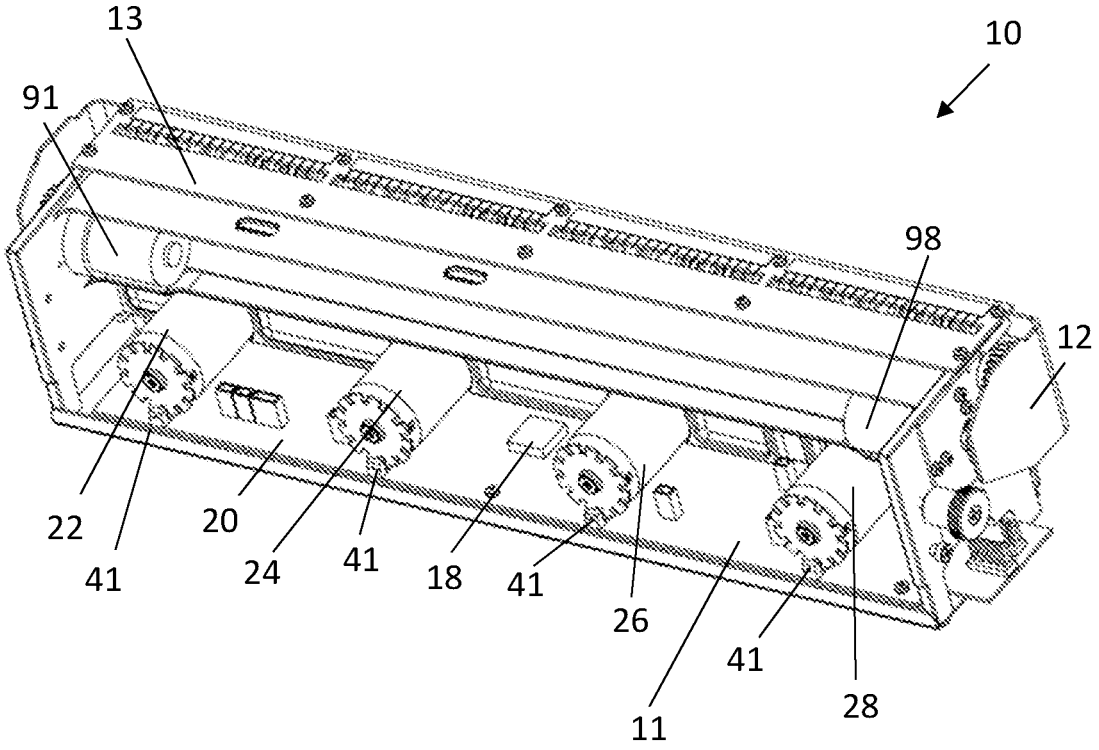
FIG. 2 is a bottom perspective view of a ticket burster device in accordance with embodiments of the present disclosure.
Figure 3:
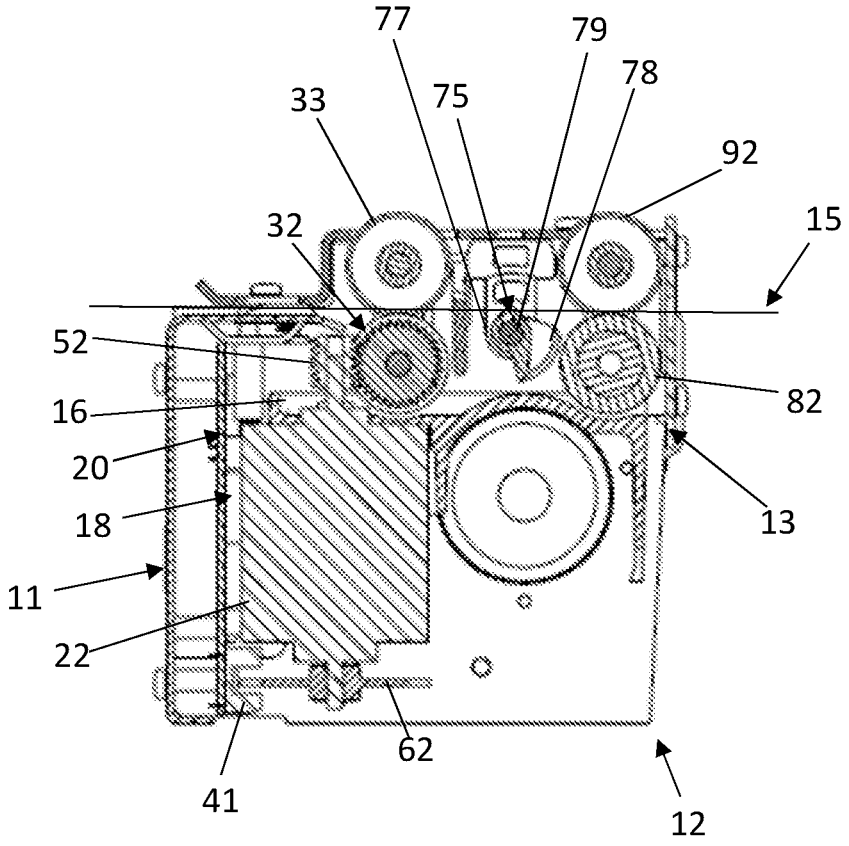
FIG. 3 is a cross-sectional view of the ticket burster device taken along line 3-3 of FIG. 1, and depicting an inserted ticket.
Figure 4:
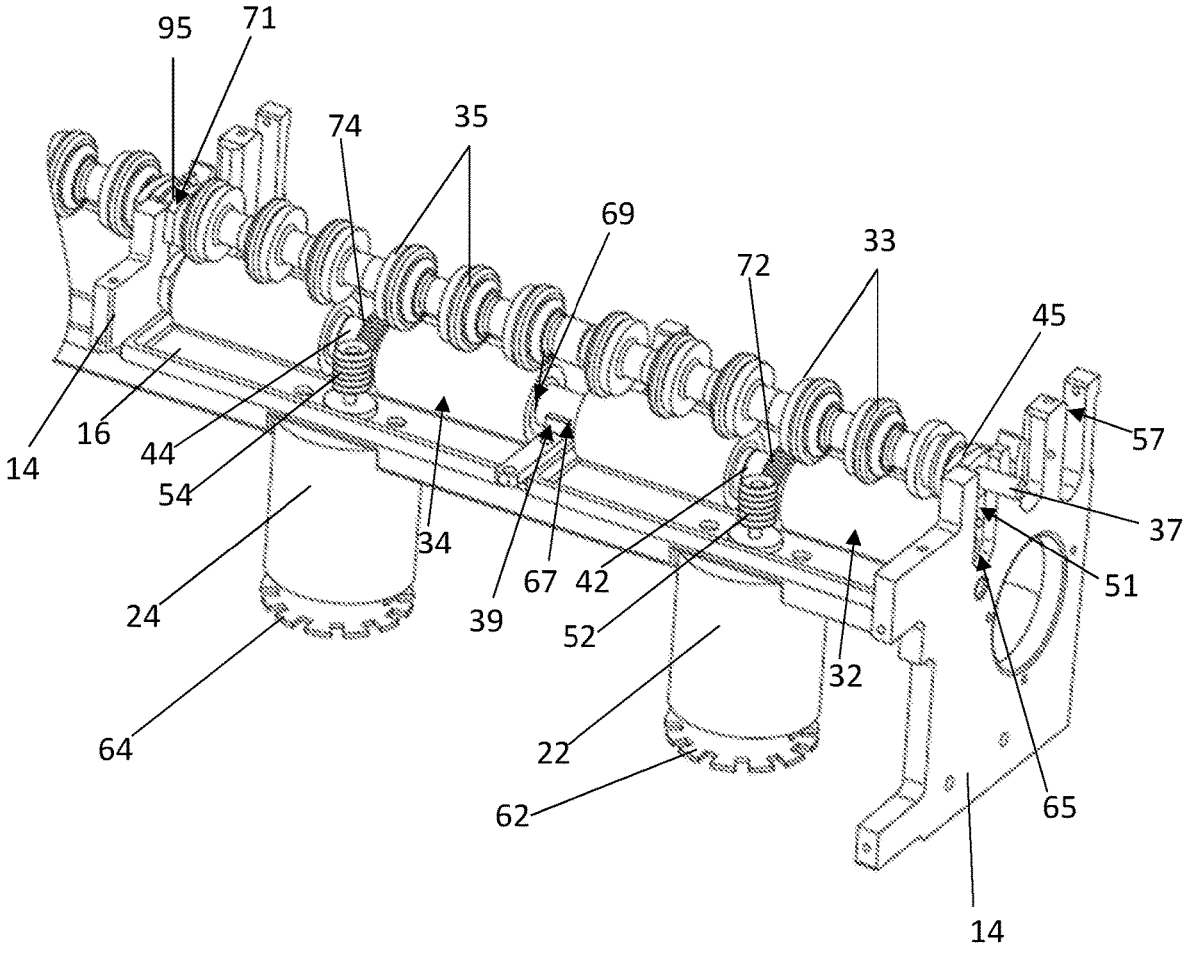
FIGS. 4 and 6 are perspective cutaway views of internal components of a ticket burster device in accordance with embodiments of the present disclosure.
Figure 5:
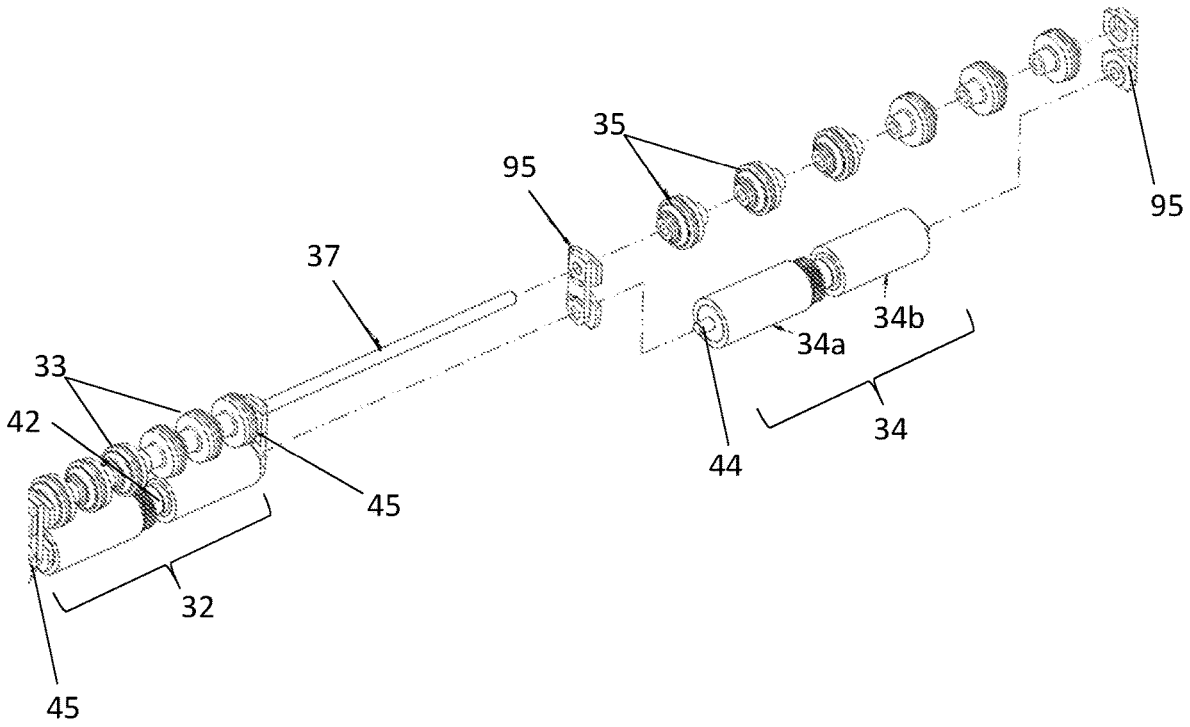
FIG. 5 is an exploded perspective view of feed drive rollers and feed idler rollers in accordance with embodiments of the present disclosure.
Figure 6:
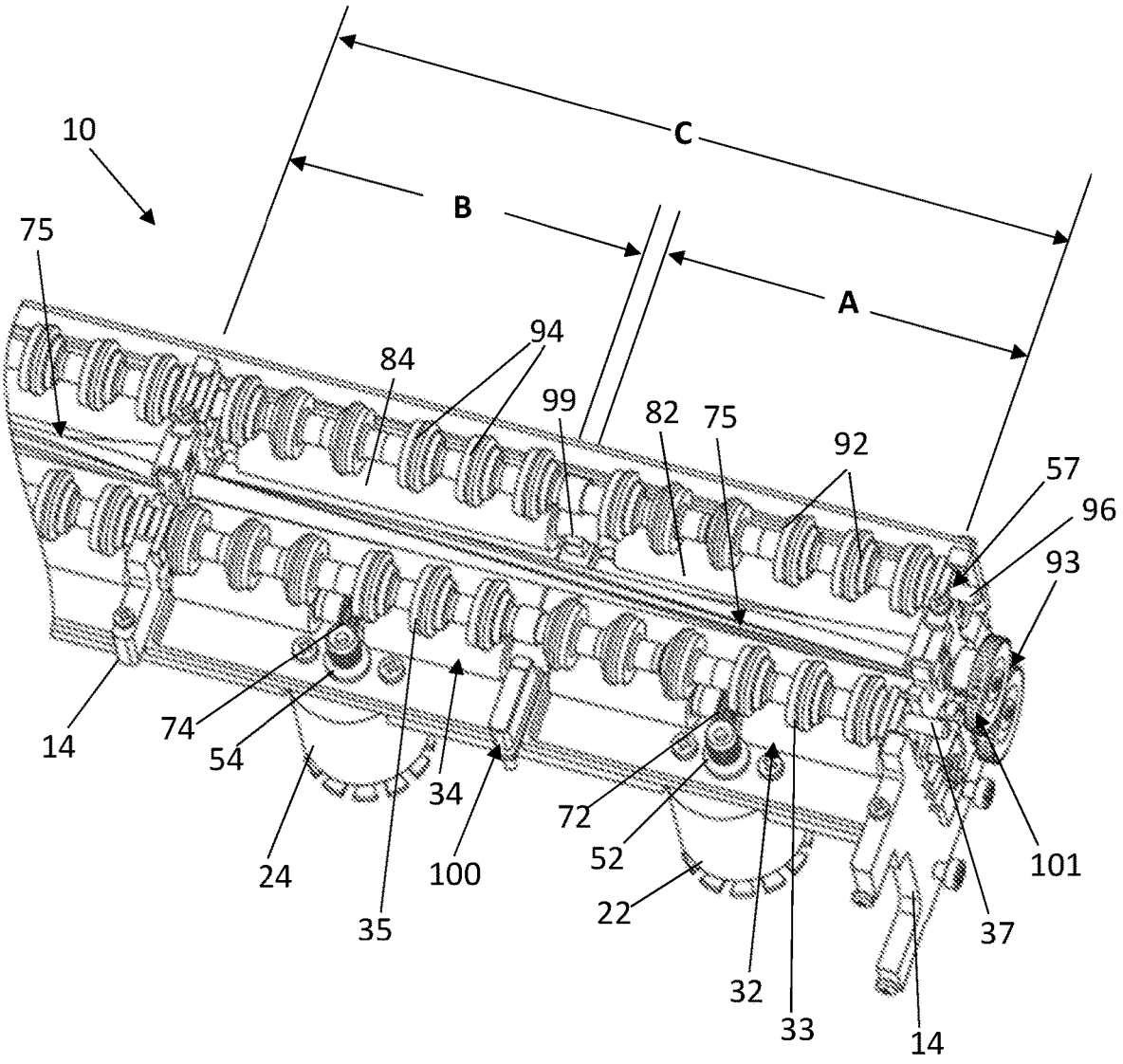

In FIGS. 1 through 10, embodiments of a ticket burster 10 in accordance with the present disclosure are shown with a housing 12 having an entry wall 11, an exit wall 13, side walls 14 and a platform 16 secured between the side walls 14. It will be appreciated that the housing may also include one or more covers, ticket drawers and other structural elements in various embodiments of the present disclosure. A controller 18 can be provided on a controller board 20 secured to the housing 12 such as by bolts, for example. The controller 18 is communicatively coupled to a group of electrically powered feed motors 22, 24, 26, 28 secured to the platform 16. As shown in FIGS. 3, 4 and 6, feed motors 22, 24 are engaged with and operable to drive a respective feed drive roller 32, 34 rotatably secured to a respective shaft 42, 44. While not fully shown in FIG. 2, it will be appreciated that the additional feed motors 26 and 28 are similarly operable to drive respective feed drive rollers to facilitate processing by the ticket burster 10 of different ticket sets during operation. As shown in FIGS. 3, 4 and 6, for example, feed motors 22, 24 can drive respective feed drive rollers 32, 34 via respective worm gears 52, 54 mating with respective gear teeth 72, 74 on the feed drive rollers 32, 34.

As further shown in FIGS. 3, 4 and 6, each feed motor 22, 24 is attached to a respective code wheel 62, 64, which passes through an optical sensor (e.g., 41 in FIG. 3) that counts the number of slots in the code wheel 62, 64 to assess the distance each passing ticket (e.g., 15 in FIG. 3) travels during operation. Corresponding feed idler rollers 33, 35 rotatably secured about a shaft 37 push incoming tickets (e.g., 15 in FIG. 3) against the respective feed drive rollers 32, 34 to generate enough friction so that the tickets do not slip during operation. The feed drive rollers 32, 34 move tickets being processed towards respective exit rollers, including exit drive rollers 82, 84 and exit idler rollers 92, 94. In various embodiments, once a ticket passes the exit drive and idler rollers (e.g., 82, 92), both the exit drive roller (e.g., 82) and the corresponding feed drive roller (e.g., 32) will move the ticket.

As shown in FIGS. 4 and 5, in various embodiments, the feed idler rollers (e.g., 33, 35) are rotatably secured to a single shaft 37. It will be appreciated that embodiments of feed drive roller 34 can encompass multiple rollers 34*a*, 34*b* (FIG. 5) rotatably secured about shaft 44, and embodiments of the remaining feed drive rollers (e.g., 32) can similarly encompass a multiple roller design. While the feed drive rollers 32, 34 may be secured to a single shaft, the feed drive rollers 32, 34 are shown in FIGS. 3, 4 and 6 on respective and separated shafts 42, 44. Regardless, the feed drive rollers 32, 34 are axially aligned and spaced apart, which facilitates aligned reception and processing of tickets during operation. In various embodiments, bearing mounts 45 secured to the shafts 37, 42, 44 allow the shafts 42, 44 for the feed drive rollers 32, 34 to rotate independently of one another, while still maintaining stability and proper distance from shaft 37. As shown in FIG. 4, shaft 42 is secured at a first end 65 to a bearing mount 45 maintained in a groove 51 of side wall 14, and is further maintained at a second end 67 by a support 39 secured to the platform 16 between the feed drive roller 32 and feed drive roller 34. In similar fashion, shaft 44 for feed drive roller 34 is maintained at a first end 69 by support 39 and is secured at a second end 71 to a separate bearing mount 95. By rotating independently, feed drive rollers 32, 34 can be driven only when needed in order to process a ticket.

With the current availability of various sizes of lottery tickets, there is a need to provide sufficient clearance for larger sized lottery tickets to be processed to an exit area of a ticket burster while ensuring that such tickets are processed smoothly. Should there be a wall (e.g., 14 in FIG. 4) in the path of travel of such a ticket, it will not reach the exit area. Further, should only one feed drive roller be rotated with a ticket having a size that extends over multiple feed drive rollers, such a ticket is not likely to be cleanly burst, and may become jammed or only partially burst toward the exit area. By providing for operation of adjacent feed drive rollers in unison or independently, along with a ticket pathway that may be opened or closed by a dividing wall that informs the controller which drive profile to employ, embodiments of the ticket burster disclosed herein overcome technical challenges and provide a versatile ticket burster for efficiently handling lottery tickets of all sizes.

As shown in FIG. 6, the exit idler rollers 92, 94 are secured about a single exit idler shaft 96 and the exit drive rollers 82, 84 are secured about a single exit drive shaft 99. In various embodiments, the exit idler rollers 92, 94 are secured to the exit idler shaft 96 using a set screw, and the exit idler shaft 96 is rotatably secured to side walls 14 and within a slot 57, shown in FIGS. 4 and 6. Bearing mounts (not shown) similar to bearing mounts 45, 95 are employed to maintain the distance between exit drive shaft 99 and exit idler shaft 96, and exit drive shaft 99 is rotatably secured to side walls 14 and within slot 57. An exit motor 98 (see FIG. 2) secured to the housing 12 is communicatively coupled to the controller 18 and operable to drive the exit drive shaft 99 via suitable gears, similar to the operation of the cutter blade as described elsewhere herein. In various embodiments, gripping elements of rubber or similar material are provided on the feed drive rollers, feed idler rollers, exit drive rollers and/or exit idler rollers to assist with gripping tickets as they pass through the ticket burster 10.

As shown in FIGS. 3 and 6, cutter blades 75 are secured about a single axle 79 within the interior of the housing 12. In various embodiments, each cutter blade 75 is secured to side walls 14 and can be provided, for example, as a sleeve 77 placed around the axle 79, wherein the sleeve 77 includes a substantially helically shaped flange 78 extending therefrom. It will be appreciated that a single axle 79 can be employed for all cutter blades 75, such that when a cutter blade motor (91 in FIG. 2) is engaged, the cutter blade motor 91 initiates rotation of the axle 79, thereby rotating each cutter blade 75 in the ticket burster 10. Such rotation can be initiated via a motor gear 93 engaging a cutter blade axle gear 101, for example. Cutter blade motor 91 is communicatively coupled to controller 18 and receives instructions from the controller 18 to initiate rotation of the axle 79. When rotated against a ticket, the helical flange 78 of the cutter blade 75 puts tearing pressure on one portion of a perforated ticket connection at a time, thereby effectively simulating a manual tearing motion. In various embodiments, the flange 78 can be a blade or sharpened edge that acts to cut passing tickets at the perforated edge. As shown in FIGS. 3 and 6 through 10, the cutter blades 75 are positioned between the feed drive rollers (e.g., 32) and the exit drive rollers (e.g., 82), going from the entry wall 11 to the exit wall 13 of the device 10.

In various embodiments, the controller 18 carries out instructions to process tickets, such as when purchased through a self-service terminal, for example. Other electronic control components can be secured to the controller board 20, such as one or more code wheel sensors 41 for pairing with each motor 22, 24, 26, 28, for example. It will be appreciated that any manner of control or power components can be mounted on the controller board 20 for operation of the individual feed motors 22, 24, 26, 28, cutter blade motor 91 and/or exit motor 98 as described herein. The controller 18 can be configured with one or more drive profiles specific to the size or dimension of the lottery tickets to be processed through the ticket burster 10. The drive profiles may be written into the operating memory of the controller 18, hard-wired in the controller 18, or otherwise stored in a memory accessible to the controller 18. In various embodiments, the controller 18 is in communication with the feed drive motors 22, 24, 26, 28, the cutter blade motor 91 and the exit drive motor 98 and controls operation thereof based on the drive profiles.

Figure 7:
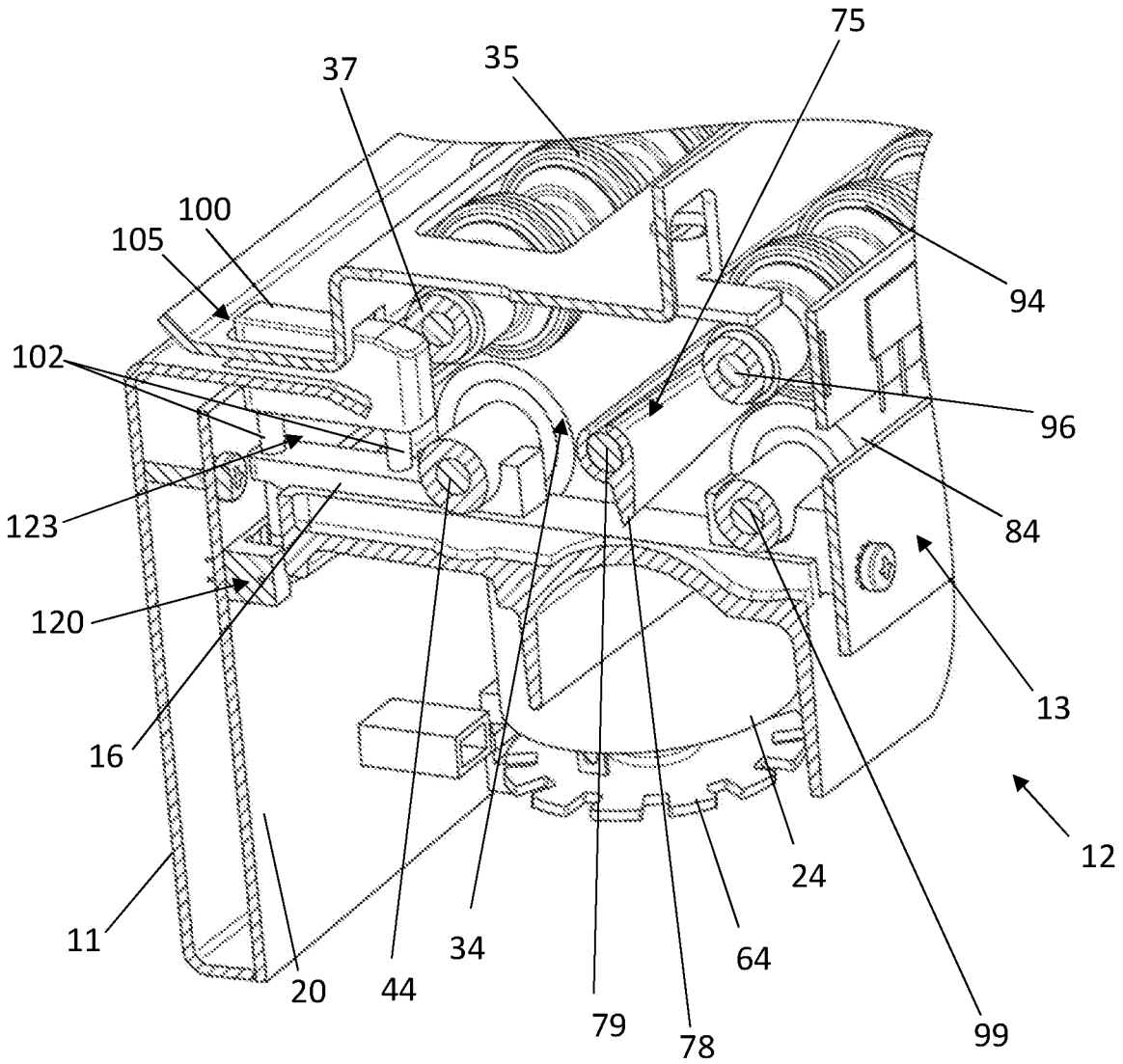
FIGS. 7 and 8 are perspective cutaway views in partial cross-section showing embodiments of a ticket burster device in accordance with the present disclosure.
Figure 8:
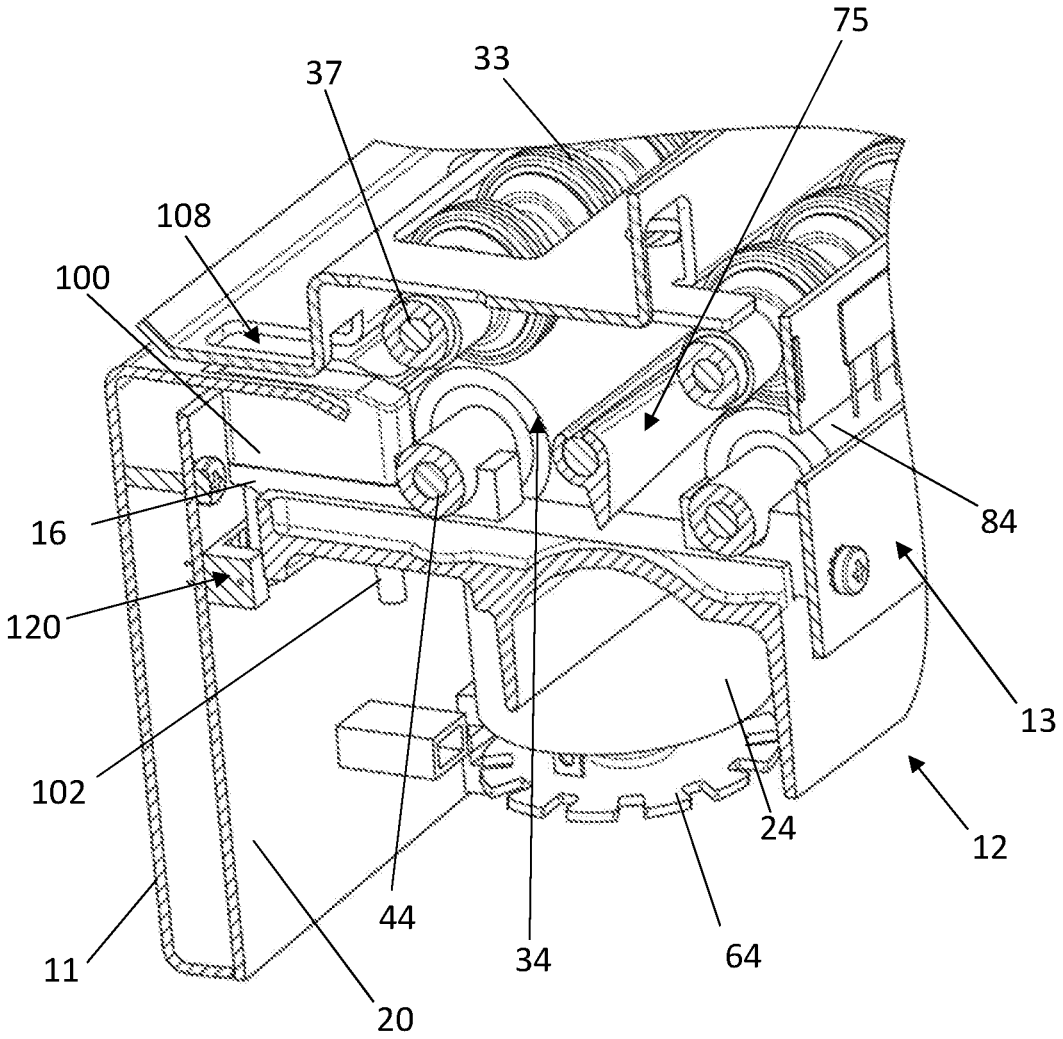

In various embodiments as shown in FIGS. 6 through 10, for example, a dividing wall 100 is provided, and a sensor 120 communicatively coupled to the controller 18 operates to sense a position of the dividing wall and instruct the controller 18 as to the size of the tickets loaded in a connected self-service terminal for dispensing by the ticket burster 10. As shown in FIGS. 7 and 8, the dividing wall 100 can be secured to the platform 16 of the housing 12 and the sensor 120 can be secured to the controller board 20, although the dividing wall 100 and sensor 120 can be located in different positions in other embodiments. In various embodiments, the dividing wall 100 is mounted onto support rods 102 and can be moved back and forth between an extended position 105 and a retracted position 108. As shown in FIGS. 6 and 7, the dividing wall 100 is secured to the housing 12 between the feed drive rollers 32, 34 and the entry wall 11 for ease of manual operation. When the dividing wall 100 is in the extended position 105, the sensor 120 sends a signal to the controller 18 to operate the feed motors 22 and 24 on either side of the dividing wall 100 independently pursuant to a stored drive profile. Each feed motor 22, 24 can then burst individual tickets of a primary size (e.g., four inches wide). When the dividing wall 100 is in the retracted position 108, the sensor 120 sends a signal to the controller 18 to synchronize the operation of the feed motors 22, 24 on either side of the dividing wall 100 to burst tickets of a supplemental size (e.g., eight inches wide) according to another stored drive profile. In such ways, embodiments of the present disclosure overcome the challenges of processing tickets of different sizes, such as from a self-service terminal, for example.

Figure 9:
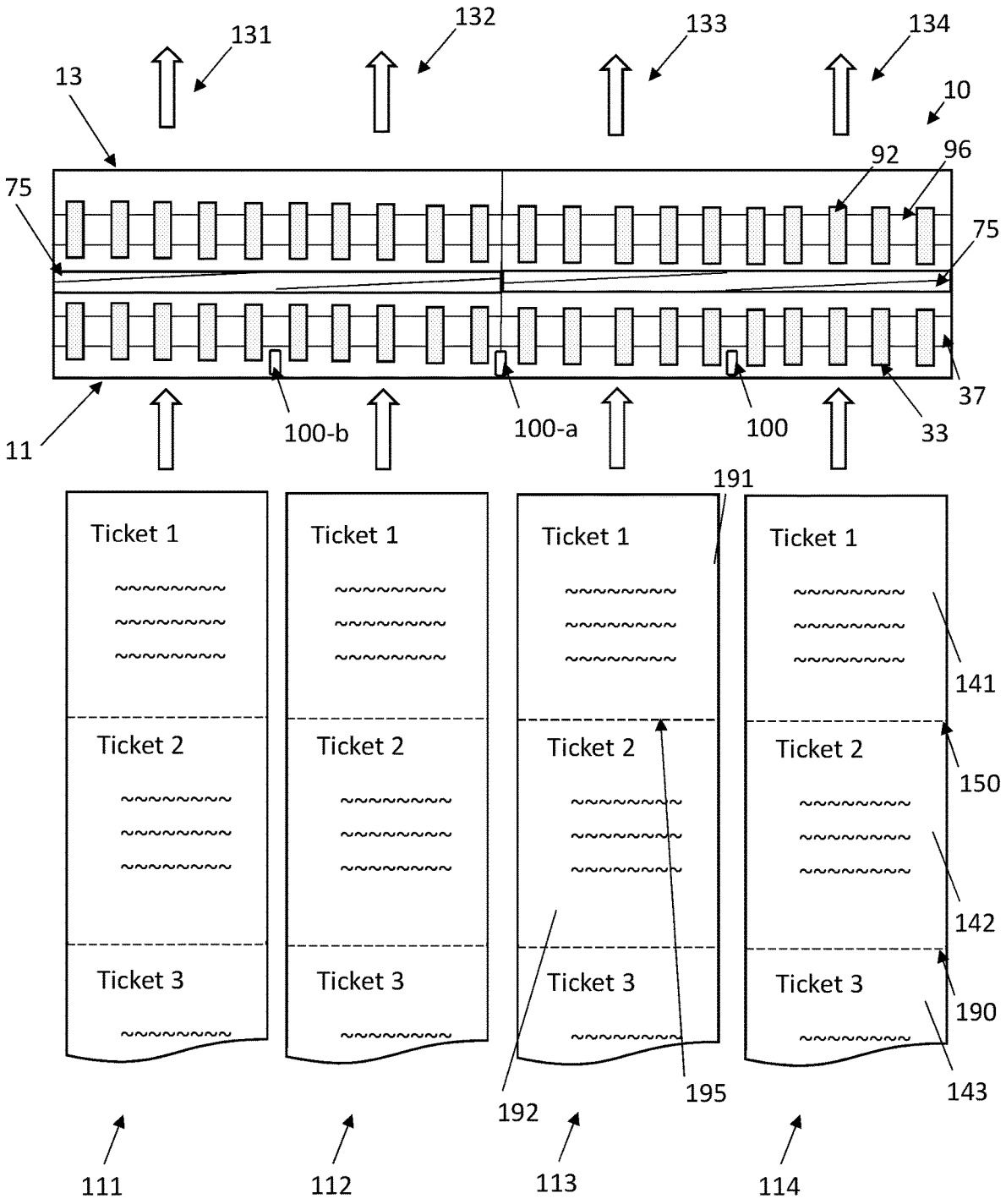
FIGS. 9 and 10 are exemplary schematic diagrams of ticket processing by a ticket burster device in accordance with embodiments of the present disclosure.
Figure 10:
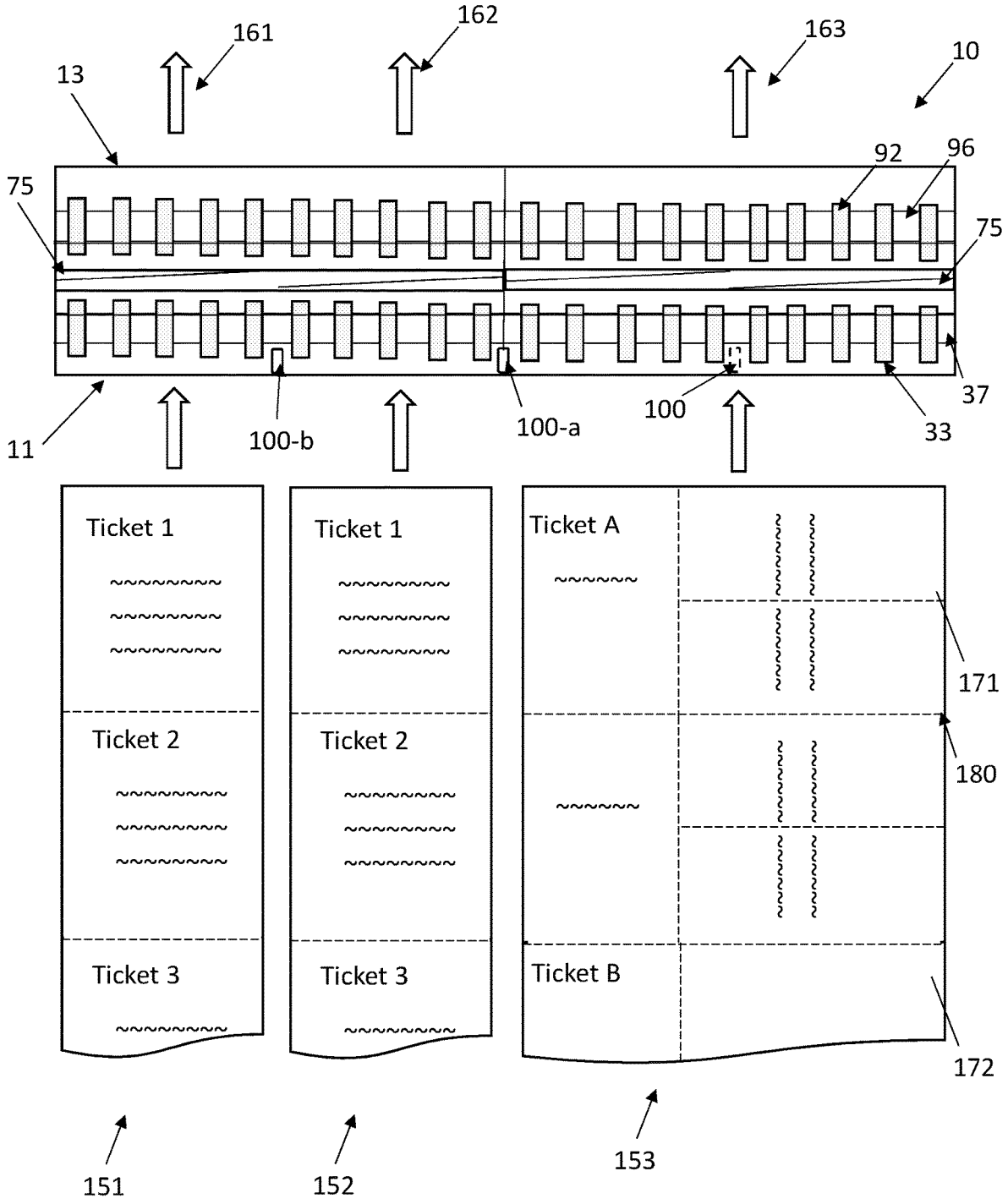

Operation is exemplified in FIGS. 9 and 10. As shown in FIG. 9, four ticket sets 111, 112, 113, 114 having primary-sized tickets (e.g., 141, 142) are aligned with respective ticket pathways 131, 132, 133, 134. A dividing wall 100-*b* separates ticket pathways 131 and 132. Dividing wall 100-*a* separates ticket pathways 132 and 133, and dividing wall 100 separates ticket pathways 133 and 134. While not shown in FIGS. 9 and 10, independent feed drive rollers such as described and shown elsewhere herein are positioned in each pathway 131, 132, 133, 134. Thus, for example, the first feed drive roller 32 can be positioned in ticket pathway 134 and the second feed drive roller 34 can be positioned in ticket pathway 133.

If a purchaser selects a ticket (e.g., 141) for purchase from ticket set 114, such as by using a self-service terminal, for example, a purchase signal is routed to the controller 18 for dispensing ticket 141. Since dividing wall 100 is in the extended position (shown at 105 in FIG. 7), the controller 18 operates instructions stored in the drive profile for primary-sized tickets, i.e., the configuration with the dividing wall 100 in the extended position. For example, and with reference to FIGS. 6 and 9, the controller 18 can instruct the feed motor 22 to drive the feed drive roller 32, whereupon ticket 141 is nipped between feed drive roller 32 and feed idler rollers 33 and fed along ticket pathway 134 to a position where the line of weakness 150 between tickets 141 and 142 is aligned with cutter blade 75. Such ticket movement can be facilitated by the controller 18 instructing the exit motor 98 to drive the exit drive roller 82 along with the feed drive roller 32 for a defined time period until the ticket bursting position is achieved. At such time, the controller 18 can instruct the cutter blade motor 91 to drive the cutter blade axle 79 so as to burst the ticket 141 along the line of weakness 150. The controller 18 can then instruct the exit motor 98 to drive the exit drive roller 82 to move the bursted ticket 141 through the exit wall 13 for delivery to the purchaser.

With reference to FIGS. 6, 8 and 10, in the instance where a supplemental-sized lottery ticket set 153 is stored and supplemental-sized lottery tickets (e.g., 171, 172) are available for purchase, such as through a self-service terminal, for example, an installer identifies the presence and particular size of the supplemental-sized lottery tickets for processing by the ticket burster 10. For illustration purposes, in FIGS. 9 and 10, the supplemental-sized lottery tickets (e.g., 171) are wider than the primary-sized lottery tickets (e.g., 141). The installer may manually depress the dividing wall 100 into the retracted position (depicted in dashed lines in FIG. 10), whereupon the sensor 120 detects that the dividing wall 100 is in the retracted position (108 in FIG. 8), and informs the controller 18 to change the drive profile for operation of the feed motors 22, 24 on either side of the dividing wall 100. In this variation, a pair of independent feed drive rollers are positioned in ticket pathway 163, while another independent feed drive roller is positioned in ticket pathway 162 and another independent feed drive roller is positioned in ticket pathway 161. For example, the first and second feed drive rollers 32, 34 can together be positioned in ticket pathway 163 when the dividing wall 100 is in the retracted position.

With reference to FIGS. 6 and 10, the controller 18 can then instruct the feed motors 22, 24 to drive the respective feed drive rollers 32, 34 in unison, whereupon supplemental-sized ticket 171 is nipped between feed drive rollers 32, 34 and feed idler rollers 33 and fed along ticket pathway 163 to a position where the line of weakness 180 between tickets 171 and 172 is aligned with cutter blade 75. It will be appreciated that ticket pathway 163 is effectively the combination of ticket pathways 133, 134 for primary-sized tickets in FIG. 9. Such ticket movement can be facilitated by the controller 18 instructing the exit motor 98 to drive the exit drive rollers 82, 84 for a defined time period until the ticket bursting position is achieved. At such time, the controller 18 can instruct the cutter blade motor 91 to drive the cutter blade axle 79 so as to rotate in ticket pathway 163 and burst the ticket 171 along the line of weakness 150. The controller 18 can then instruct the exit motor 98 to drive the exit drive rollers 82, 84 to move the bursted ticket 171 through the exit wall 13 for delivery to the purchaser.

Should the supplemental-sized ticket set 153 be replaced with differently sized ticket sets, such as primary-sized ticket sets 113 and 114 in FIG. 9, the installer may simply push the dividing wall 100 to release it from the retracted position 108 back to the extended position 105. At such time, the sensor 120 detects the changed position of the dividing wall 100 and communicates the changed position to the controller 18. The controller 18 then changes the drive profile for operation of the feed motors 22, 24 on either side of the dividing wall 100 such that the feed motors 22, 24 will operate respective feed drive rollers 32, 34 independently. In such instance, and with reference to FIGS. 6 and 9 again, the controller 18 can instruct the feed motor 22 to drive the feed drive roller 32, whereupon ticket 142 is nipped between feed drive roller 32 and feed idler rollers 33 and fed along ticket pathway 134 to a position where the line of weakness 190 between tickets 142 and 143 is aligned with cutter blade 75. Similarly, the controller 18 can instruct the feed motor 24 to drive feed drive roller 34 if ticket 191 is selected for purchase, whereupon ticket 191 is nipped between feed drive roller 34 and feed idler rollers 35 and fed along ticket pathway 133 to a position where the line of weakness 195 between tickets 191 and 192 is aligned with cutter blade 75. A latching mechanism can be provided as part of dividing wall 100 to facilitate retention of the dividing wall 100 in the extended and retracted positions, as well as in the movement of the dividing wall therebetween.

It will be appreciated that the dividing wall 100 does not interfere with ticket movement during operation, although if the dividing wall is in the extended position, it can physically interfere with the insertion and loading of tickets of a size that requires the dividing wall to be in the retracted position. In this way, and as a specific example, an operator cannot incorrectly load a supplemental-sized ticket when the dividing wall is in the extended position. It will further be appreciated that embodiments of the present disclosure can employ a single dividing wall 100 or multiple dividing walls (e.g., 100, 100-*a*,100-*b* in FIGS. 9 and 10, or a portion thereof). It will further be appreciated that the cutter blade 75 is of sufficient length to accommodate operation of the ticket burster 10 with the dividing wall 100 in either the retracted 108 or the extended 105 position. In various embodiments, such as shown in FIG. 6, for example, the cutter blade 75 has a length C that is greater than or equal to the length A of the first feed drive roller 32 combined with the length B of the second feed drive roller 34. As shown in FIGS. 9 and 10, the cutter blade 75 can thus rotate in multiple ticket pathways, requiring no change in operation regardless of the position of dividing wall 100. If the cutter blade did not extend as described, but rather only extended as far as the length (e.g., A) of one feed drive roller (e.g., 32), then it would not be likely to properly burst supplemental-sized lottery tickets, which employ adjacent feed drive rollers (e.g., 32, 34) operating in unison as disclosed herein. Even if two cutter blades were independently employed with respective feed drive rollers (e.g., 32, 34), such cutter blades would not be likely to properly burst supplemental-sized lottery tickets as disclosed herein, as there may be a portion in between the cutter blades that is not properly burst. By providing a single cutter blade 75 of sufficient length according to embodiments described herein, the cutter blade 75 overcomes challenges presented with effectively bursting supplemental-sized lottery tickets.

The sensor 120 can be embodied, for example, as an optical switch which detects light emitted through an opening, such as opening 123 extending between the dividing wall 100, platform 16 and support rods 102. When the light is detected, the sensor 120 detects that the dividing wall 100 is in the extended position 105 and informs the controller 18 accordingly. When the light is not detected, the sensor 120 detects that the dividing wall 100 is in the retracted position 108 and informs the controller 18 accordingly.

In various embodiments, the dividing wall 100 can be embodied as a contact switch, wherein the retracted position provides for contact between the dividing wall 100 and platform 16, for example, which then communicates to controller 18 that the dividing wall 100 is in the retracted position 108. If the dividing wall 100 is in the extended position 105, there would be no contact with the platform 16, thereby informing the controller 18 that the dividing wall 100 is in the extended position 105.

Figure 11:
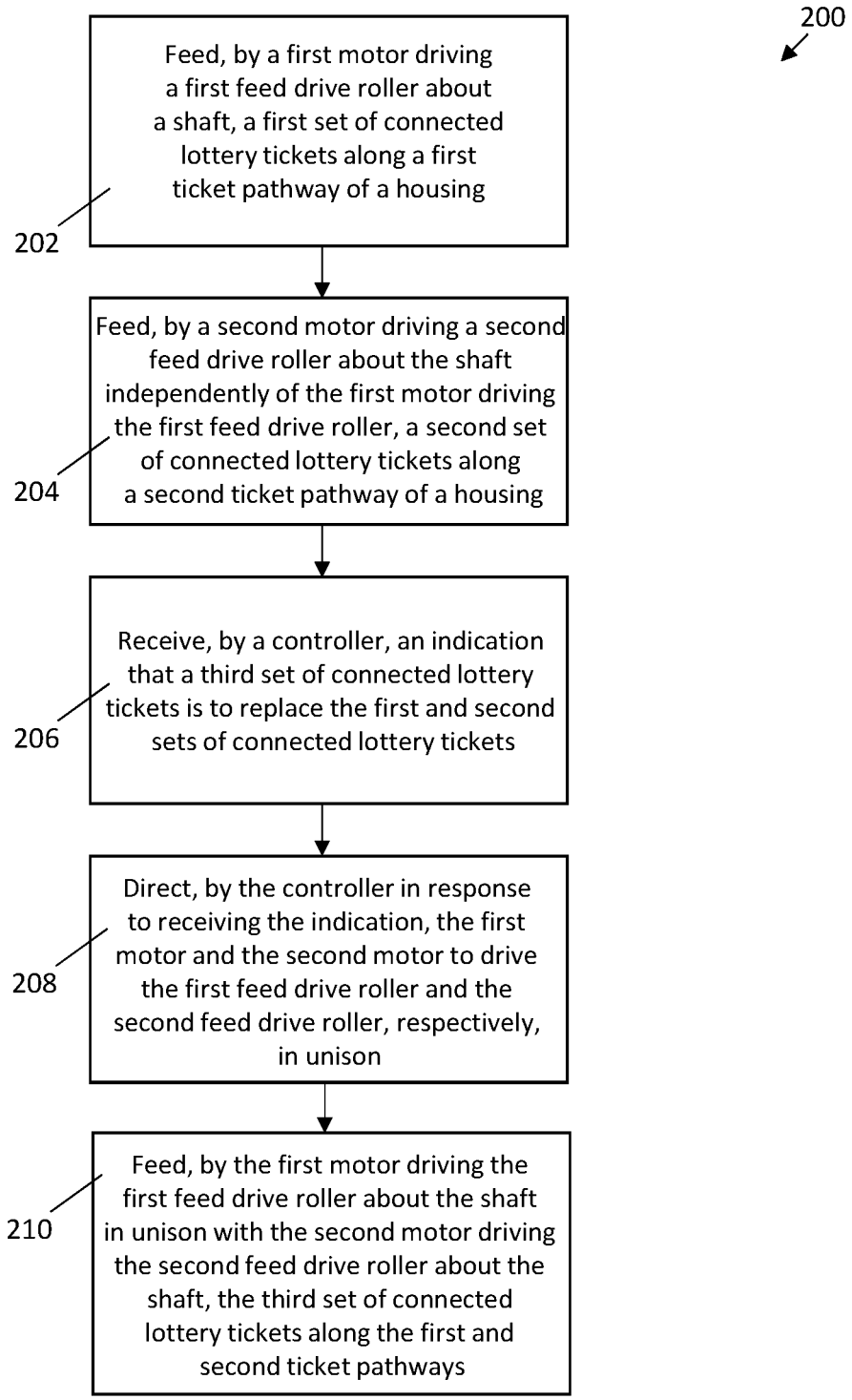
FIG. 11 is a flow diagram illustrating a method of operating a ticket burster device in accordance with embodiments of the present disclosure.

Referring now to FIG. 11, a flowchart of an example embodiment of a process 200 for operating the ticket burster disclosed herein is illustrated. In one embodiment, this process is embodied in one or more software programs stored in one or more memories and executed by one or more processors or servers. As described above, this process can be embodied as one or more drive profiles written into the operating memory of the controller 18, hard-wired in the controller 18, or otherwise stored in a memory accessible to the controller 18. Although this process is described with reference to the flowchart illustrated in FIG. 11, it should be appreciated that many other methods of performing the acts associated with this process may be employed. For example, the order of certain steps described may be changed, or certain steps described may be optional.

As at block 202, the process 200 involves feeding, by a first motor driving a first feed drive roller about a shaft, a first set of connected lottery tickets along a first ticket pathway of a housing. As at block 204, the process involves feeding, by a second motor driving a second feed drive roller about the shaft independently of the first motor driving the first feed drive roller, a second set of connected lottery tickets along a second ticket pathway of a housing. As described above, the first and second motors can be instructed to drive respective first and second feed drive rollers to drive feed respective sets of tickets along their respective pathways based upon instructions received from the controller executing a drive profile. It will be appreciated that the first and second sets of lottery tickets can be of the primary size referenced in connection with FIGS. 9 and 10.

As at block 206, the controller receives an indication that a third set of connected lottery tickets is to replace the first and second sets of connected lottery tickets. It will be appreciated that the third set of connected lottery tickets can be of a supplemental size that is larger than the primary size, as referenced in connection with FIGS. 9 and 10. It will further be appreciated that the indication can be a communication from a sensor that a dividing wall secured between the first and second ticket pathways is in a retracted position such that the third set of connected lottery tickets can be appropriately processed by the ticket burster, as described elsewhere herein. As at block 208, in response to receiving the indication, the controller directs the first motor and the second motor to drive the first feed drive roller and the second feed drive roller, respectively, in unison. This operation can occur, for example, as the controller executes a different drive profile from the drive profile used to direct the first motor and the second motor to operate independently. As at block 210, the process continues with feeding, by the first motor driving the first feed drive roller about the shaft in unison with the second motor driving the second feed drive roller about the shaft, the third set of connected lottery tickets along the first and second ticket pathways. In this way, the process permits tickets of different sizes to be effectively accommodated by the ticket burster as described elsewhere herein.

It will be appreciated that, in various embodiments, the process can further separate the third set of connected lottery tickets by a cutter blade rotating in the first and second ticket pathways, wherein the cutter blade is instructed by the controller to rotate at the appropriate time based upon one or more drive profiles. It will further be appreciated that, upon the controller receiving another communication from the sensor that the dividing wall secured between the first and second ticket pathways is in an extended position, such that tickets of a primary size are again ready to be processed instead of the third set of connected lottery tickets, the process can operate such that the controller re-directs the first motor to drive the first feed drive roller independently of the second motor driving the second feed drive roller according to one or more drive profiles.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the controller, partly on the controller, partly on the controller and partly on a remote computer or entirely on the remote computer. In the latter scenario, the remote computer may be connected to the controller through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

What is claimed is:

1. A device comprising:

a housing;

a shaft secured within the housing;

first and second feed drive rollers spaced apart and rotatably secured about the shaft;

a first feed motor engaged with the first feed drive roller;

a second feed motor engaged with the second feed drive roller;

a dividing wall secured to the housing, wherein the dividing wall is movable from an extended position and a retracted position relative to the first and second feed drive rollers such that the dividing wall in the extended position divides a first ticket pathway within the housing and having a first width from a second ticket pathway within the housing and having a second width, the first ticket pathway configured to receive a first ticket having the first width, the second ticket pathway configured to receive a second ticket having the second width, wherein a third ticket pathway having a third width is defined when the dividing wall is in the retracted position, the third ticket pathway configured to receive a third ticket having the third width, wherein the third width is at least as wide as a sum of the first and second widths, and wherein the dividing wall in the extended position prevents a ticket having the third width from moving along the first and second ticket pathways;

a sensor secured to the housing and detecting whether the dividing wall is in the extended or the retracted position; and a controller communicatively coupled to the sensor and the first and second feed motors, wherein the controller comprises a processor and a memory storing instructions, which when executed by the processor, cause the processor to instruct the first and second feed motors to drive the first and second feed drive rollers, respectively, in unison upon receiving a communication from the sensor that the dividing wall is in the retracted position.

2. The device of claim 1, wherein the instructions further cause the processor to instruct the first feed motor to drive the first feed drive roller independently of instructing the second feed motor to drive the second feed drive roller upon receiving a communication from the sensor that the dividing wall is in the extended position.

3. The device of claim 1, further comprising a cutter blade rotatably secured within the housing and axially parallel with the shaft, wherein the first feed drive roller comprises a first feed drive roller length, the second feed drive roller comprises a second feed drive roller length, and the cutter blade comprises a cutter blade length that is greater than or equal to the first feed drive roller length combined with the second feed drive roller length.

4. The device of claim 1, wherein the shaft comprises a first shaft and a second shaft, and wherein the first feed drive roller is secured about the first shaft and the second feed drive roller is secured about the second shaft.

5. The device of claim 1, wherein the housing further comprises an entry wall, and wherein the dividing wall is secured to the housing between the feed drive rollers and the entry wall.

6. The device of claim 1, wherein the first feed drive roller is positioned in the first ticket pathway, the second feed drive roller is positioned in the second ticket pathway.

7. The device of claim 1, wherein the first and second feed drive rollers are together positioned in the first ticket pathway when the dividing wall is in the retracted position.

* * * * *